United States Patent [19]

Thomas

[11] 4,318,155

[45] Mar. 2, 1982

[54] RESIDUAL MAGNETISM REVERSING CIRCUIT FOR AN ELECTROMAGNETIC CLUTCH

[75] Inventor: Steven L. Thomas, Dayton, Ohio

[73] Assignee: General Motors Corporation, Detroit, Mich.

[21] Appl. No.: 161,288

[22] Filed: Jun. 20, 1980

[51] Int. Cl.[3] ..... H01H 47/02

[52] U.S. Cl. ..... 361/156; 361/159

[58] Field of Search ..... 361/149, 155, 156, 159

[56] References Cited

U.S. PATENT DOCUMENTS 3,230,432 1/1966 Martin .

3,558,997 1/1971 Derc .

3,730,317 5/1973 Jaeschke .

FOREIGN PATENT DOCUMENTS 520631 7/1976 U.S.S.R. ..... 361/156

*Primary Examiner*—Harry E. Moose, Jr.

*Attorney, Agent, or Firm*—Mark A. Navarre

[57] ABSTRACT

Residual magnetism in the engageable members of an electromagnetic clutch is relieved following deenergization of the clutch coil by charging a capacitor with the inductive energy stored in the coil at deenergization thereof and subsequently discharging the capacitor into the coil in a direction opposite to that applied to the coil during energization.

3 Claims, 2 Drawing Figures

RESIDUAL MAGNETISM REVERSING CIRCUIT FOR AN ELECTROMAGNETIC CLUTCH

This invention relates to a control circuit for an electromagnetic clutch and more particularly to a circuit for relieving residual magnetism in the clutch following deenergization of the clutch coil to provide positive disengagement of the clutch.

Electromagnetic clutches generally comprise driving and driven members shiftable in response to selective energization of a clutch coil to engage or disengage the members and thereby operate a load device. The members are normally maintained in a disengaged relationship, clutch engagement being achieved by energizing the clutch coil to attract the driving and driven members. When the clutch coil is deenergized, however, the clutch members tend to remain engaged due to residual magnetism in the engaged clutch members. This problem is pronounced if there are no air gaps in the energized magnetic circuit, as with a rotating coil type electromagnetic clutch. In order to positively disengage the clutch members following deenergization of the clutch coil, it has been proposed to relieve the residual magnetism by momentarily applying a voltage to the clutch coil opposite in polarity to that applied to the coil during energization. Typically, a charge storage element such as a capacitor is connected in series or parallel with the coil energization circuit, and upon deenergization of the coil, various circuit switches operate to discharge the capacitor through the coil in a polarity opposite to the coil energization voltage. A drawback of such prior art circuits is that the placement of charge storage elements in the energization circuit adversely affects the response time of the clutch, tending to prolong the clutch engagement time and increase clutch wear.

Accordingly, it is an object of this invention to provide an improved circuit for momentarily applying a reverse voltage potential to an electromagnetic clutch coil at deenergization thereof wherein the circuit elements are electrically isolated from the coil energization circuit so as not to affect the response time of the clutch.

It is a further object of this invention to provide an improved circuit for relieving residual magnetic buildup in an electromagnetic clutch following deenergization of the clutch coil wherein inductive energy stored in the clutch coil at deenergization thereof charges a capacitor and wherein energy return circuit elements discharge the capacitor through the clutch coil in a direction opposite the energization voltage when the energy stored in the capacitor reaches a desired value.

These objects are carried forward by circulating the inductive transient energy at deenergization through a series circuit comprising a free-wheeling diode and a capacitor. A second circuit path in parallel with the capacitor provides a control voltage for controlling the conduction of a transistor, the collector-emitter circuit of which is connected in parallel to the free-wheeling diode. The conduction path of the transistor is opposite to that of the diode so that when the control voltage is sufficient to bias the transistor to a conductive state following deenergization of the clutch coil, the capacitor is discharged through the clutch coil to remove residual magnetic buildup in the clutch members. When the clutch coil is being energized, the transistor and the free-wheeling diode are reversed biased so that the remaining circuit elements are electrically isolated from the coil energization circuit and therefore do not affect the response time of the clutch. The circuit thereby operates to ensure positive disengagement of the clutch members and to reduce inductive stress at deenergization of the clutch coil. Furthermore, the circuit is easily installed since it is merely connected in parallel with the clutch coil.

IN THE DRAWINGS

Figure 1:
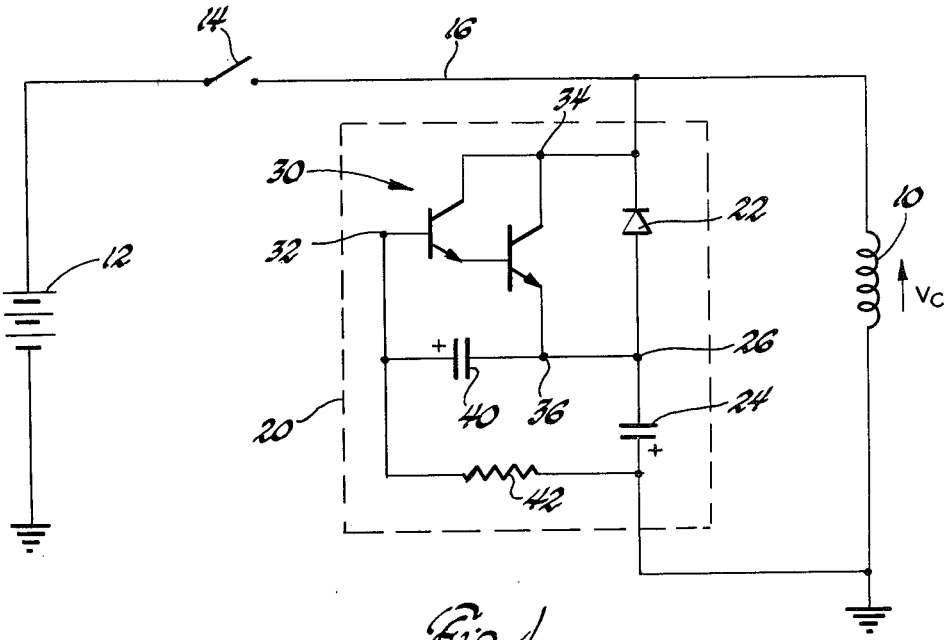
FIG. 1 is a circuit diagram of a clutch coil energization circuit and the residual magnetism reversing circuit of this invention.

Referring now to FIG. 1, reference numeral 10 designates the coil of an electromagnetic clutch, such as a rotating coil-type clutch, used to engage and disengage an automotive air conditioning compressor. Although it will be understood that the control circuit of this invention may be beneficially used with a variety of clutch designs, one such clutch is disclosed and described in detail in the U.S. Pat. No. 4,190,141, assigned to the assignee of this invention. Battery 12 provides a source of direct current and switch 14 selectively connects or disconnects battery 12 and coil 10 through conductor 16 to energize or deenergize coil 10 and thereby engage or disengage the clutch. If the clutch load is an automotive air conditioning compressor, switch 14 is preferably a relay or other electrical switch actuated in a manner to cycle the clutch on and off as a function of the compressor temperature.

Reference numeral 20 generally designates the residual magnetism reversing circuit of this invention, and it will be seen that circuit 20 is connected directly in parallel with coil 10. Free-wheeling diode 22 and capacitor 24 are serially connected in parallel with coil 10, forming a circuit junction 26 therebetween. Reference numeral 30 generally designates a Darlington transistor having a base or control electrode 32, a collector electrode 34 and an emitter electrode 36. The collector-emitter circuit of transistor 30 is connected in parallel with free-wheeling diode 22, but poled in a manner to be conductive in the opposite direction. Capacitor 40 and resistor 42 are serially connected in parallel with capacitor 24 to provide a control voltage between base electrode 32 and emitter electrode 36 for controlling the conduction of Darlington Transistor 30.

Figure 2:
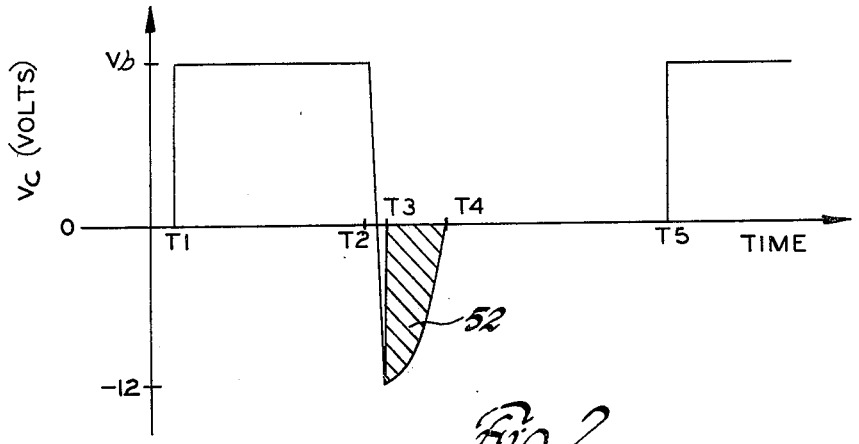
FIG. 2 is an idealized graph of the voltage applied to the clutch coil (Vc) as a function of time.

The operation of the circuit will now be decribed in reference to FIG. 2 which depicts the voltage across coil 10 (Vc) with respect to time. When switch 14 is closed at time T1, the voltage across coil 10 rises to substantially that of the terminal voltage of battery 12 (Vb) until switch 14 is opened at time T2. While switch 14 is closed, free-wheeling diode 22 and Darlington transistor 30 are reverse biased, electrically isolating the remaining circuit elements of circuit 20 from conductor 16. When Vc goes negative (shortly after time T2), the inductive energy stored in coil 10 is circulated through a first circuit path comprising free-wheeling diode 22 and capacitor 24, and a second circuit path comprising free-wheeling diode 22, capacitor 40, and resistor 42. Capacitors 24 and 40 are thereby charged in the polarity indicated, and at time T3 the voltage across capacitor 40 is sufficient to bias Darlington transistor 30 conductive, discharging capacitor 24 through coil 10. It will be noted that the voltage thereby applied to coil 10 is opposite in polarity to that applied by battery 12 during time period T1-T2, and cross-hatched area 52 represents the amount of energy returned to coil 10 between time period T3 when transistor 30 is biased conductive and time period T4 when transistor 30 returns to a non-conductive state. The energy returned by circuit 20 effectively relieves the residual magnetism in the clutch members so that the clutch members are positively disengaged shortly after switch 14 is opened to deenergize coil 10. At time T5, switch 14 is again closed to repeat the above-described operation.

Although various circuit values may be effectively used in practicing this invention, the circuit values according to the preferred embodiment of this invention are as follows:

Darlington Transistor 30: DTS -2000
Free-Wheeling Diode 22: 1N4004
Capacitor 24: 300 uF, 16WVDC (Electrolytic)
Capacitor 40: 10 uF, 3WVDC (Electrolytic)
Resistor 42: 82 kohms
Battery 12: 12 volts With reference to the circuit values, capacitor 40 and resistor 42 are chosen with respect to the biasing requirements of transistor 30 so that when transistor 30 is biased to a conductive state, the energy stored in capacitor 24 is sufficient to relieve the residual magnetism in the clutch members. With the circuit values listed above, capacitor 24 is sufficiently charged at time T3 when transistor 30 becomes conductive so that the peak reverse voltage applied to coil 10 is approximately 12 volts, as indicated in FIG. 2. It will be appreciated that in addition to relieving the residual magnetism in the clutch members, this circuit operates to limit the reverse inductive stress at switch 14 to approximately 12 volts. It will also be appreciated that Darlington transistor 30 may be replaced with a single transistor, but that such replacement necessitates an increase in the capacitance (and therefore size) of capacitor 40.

While a specific embodiment is illustrated for the purpose of describing the invention, it will be appreciated that various modifications may be made thereto without departing from the scope of this invention.

The embodiments of the invention in which an exclusive property or privilege is claimed are defined as follows:

1. A control circuit for an electromagnetic clutch having an electrical coil and a pair of engageable members positioned in response to the energization of said coil, said circuit comprising in combination:

a source of direct current;

first switch means for selectively connecting or disconnecting said coil and said source;

a first series circuit comprising a capacitor and a free-wheeling diode connected in parallel to said coil so that inductive energy stored in said coil when said source is disconnected therefrom is circulated through said first series circuit to charge said capacitor and reduce the inductive stress applied to said first switch means, said diode being connected relative to said source and said capacitor in a manner to isolate said capacitor from said source to prevent said source from charging said capacitor while source is connected to said coil, whereby said capacitor does not affect the energization of said coil;

second switch means connected in parallel with said free-wheeling diode and effective when biased to a conductive state to complete a second series circuit comprising said capacitor and said coil; and voltage responsive means for biasing said second switch means to a conductive state when the voltage across said capacitor exceeds a desired value, whereby the energy stored in said capacitor following disconnection of said source from said coil is reapplied to said coil in a direction opposite to that applied by said source for relieving the residual magnetism in the engageable members of said clutch to positively disengage said members following disconnection of said source from said coil.

2. A control circuit for an electromagnetic clutch having an electrical coil and a pair of engageable members positioned in response to the energization of said coil, said circuit comprising in combination:

a source of direct current;

switch means selectively actuable to connect or disconnect said coil and said source;

a first series circuit comprising a first capacitor and a diode connected in parallel to said coil, said diode being poled in a manner to prevent said source from charging said first capacitor but to allow inductive energy stored in said coil to charge said first capacitor after said switch means is actuated to disconnect said source and said coil;

transistor means connected in parallel with said diode and poled oppositely to said diode, said transistor means being effective when biased to a conductive state to discharge said first capacitor into said coil; and RC circuit means connected in parallel with said first capacitor, said RC circuit means including a second capacitor connected in a manner to control the conduction of said transistor means so that said transistor means is biased conductive a predetermined time after said source is disconnected from said coil whereby the inductive energy transferred from said coil to said first capacitor following disconnection of said source from said coil is reapplied to said coil in a direction opposite to that applied by said source for reducing the residual magnetism in the engageable members of said clutch to positively disengage said members following disconnection of said source from said coil.

3. A control circuit for an electromagnetic clutch having an electrical coil and a pair of engageable members positioned in response to the energization of said coil, said circuit comprising in combination:

a source of direct current;

switch means selectively actuable to connect or disconnect said coil and said source;

a first series circuit comprising a first capacitor and a diode connected in parallel to said coil, said diode being poled in a manner to prevent said source from charging said first capacitor but to allow inductive energy stored in said coil to charge said first capacitor after said switch means is actuated to disconnect said source and said coil;

transistor means having an emitter-collector circuit connected in parallel with said diode and poled oppositely to said diode, said transistor being effective when biased to a conductive state to discharge said first capacitor into said coil; and a second series circuit comprising a resistor and a second capacitor connected in parallel with said first capacitor, said second capacitor being connected between the base and emitter of said transistor means so that said transistor means is biased to a conductive state when said first capacitor is charged to a desired level following disconnection of said source and said coil whereby the energy stored in said first capacitor is discharged into said coil to reverse the residual magnetism in the engageable members of said clutch to positively disengage said members following disconnection of said source from said coil.

* * * * *